United States Patent [19]

Ogawa et al.

[11] 3,997,224

[45] Dec. 14, 1976

[54] ELECTRICAL CONTACTING DEVICE

[75] Inventors: Naoki Ogawa, Yokohama; Kazuo Ikawa, Tokyo, both of Japan

[73] Assignee: Nissan Motor Co., Ltd., Japan

[22] Filed: Dec. 16, 1975

[21] Appl. No.: 641,269

[30] Foreign Application Priority Data

Dec. 23, 1974 Japan ..... 49-4463 [U]

[52] U.S. Cl. ..... 339/5 M; 339/3 S; 339/10

[51] Int. Cl.[2] ..... H01R 39/00

[58] Field of Search ..... 339/5 M, 5 R, 5 P, 5 S, 339/10, 3 R, 3 S

[56] References Cited

UNITED STATES PATENTS 2,877,435 3/1959 Alvine, Jr. ..... 339/5 M 3,614,726 10/1971 Richter et al. ..... 339/5 M X

*Primary Examiner*—Roy Lake
*Assistant Examiner*—DeWalden W. Jones
*Attorney, Agent, or Firm*—Robert E. Burns; Emmanuel J. Lobato; Bruce L. Adams

[57] ABSTRACT

A stationary outer annular holder is concentrically positioned around and radially spaced apart from a rotatable annular conductive plate member. Curved conductive spring bands are supported on the holder so as to be urged into sliding contact with the annular conductive plate member. Electrical contact and smooth rotation between the holder and the annular conductive plate member are thus ensured even during severe vibration.

8 Claims, 6 Drawing Figures

ELECTRICAL CONTACTING DEVICE

The present invention relates to an electrical contacting device for continuously providing electrical connection between stationary and rotatable electrical conductors mounted in a motor vehicle.

It is well known to mount an air-bag system in a vehicle in which an air-bag is arranged on a steering wheel in order to preferably protect a driver in the event of vehicle collision. In this type air-bag system, the system must include an electrical contacting device mounted on the steering system for transmitting an air-bag operating signal generated in an impact detecting device, positioned in a relatively stationary position of the vehicle, to an electrical gas generating device of the air-bag mounted on the rotatable steering wheel. In a collision of the vehicle, the transmittance of the air-bag operating signal from the impact detecting device into the electrical gas generating device of the air-bag must be done within several milliseconds. Therefore, the electrical contacting device used in the above-mentioned position must be made to ensure continuous connection between the impact detecting device and the electrical gas generating device of the air-bag even though it has rotatory elements and bearings.

Therefore, it is a primary object of the present invention to provide an electrical contacting device which can provide reliable and continuous electrical connection between a stationary electrical conductor and a rotatable conductor rotatable relatively to the stationary electrical conductor.

Another object of the present invention is to provide an improved electrical contacting device which can be used for assuredly transmitting an air-bag operating signal, generated in an impact detecting device mounted on a relatively stationary position of the vehicle, to the gas generating device of the air-bag mounted on the steering wheel, even under the most severe impact forces and the vibrations of various frequencies.

The other objects and merits of the present invention will be apparent from the following description of preferred embodiments of the invention taken in conjunction with the accompanying drawings, in which.

Figure 1:
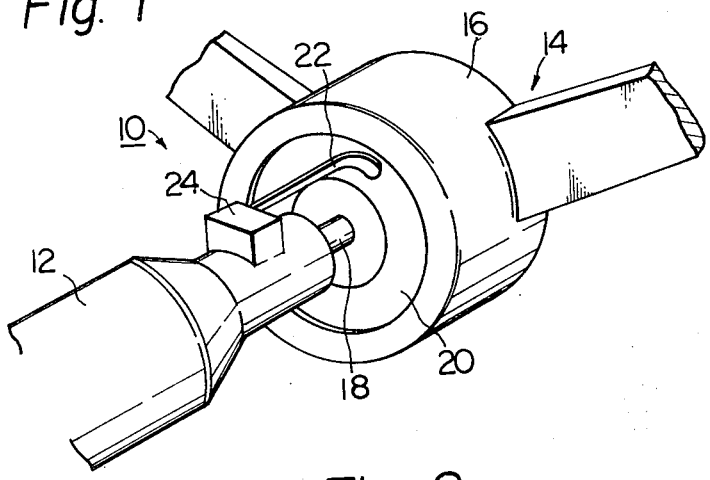
FIG. 1 is a perspective view of a steering wheel and steering column assembly equipped with a conventional electrical contacting device.

Referring now to FIG. 1, there is shown a prior art electrical contacting device generally designated by numeral 10 which is arranged between a top end portion of a steering shaft housing 12 and a steering wheel 14. The steering wheel 14 is connected at the central boss portion 16 thereof to a steering shaft 18 which is rotatably disposed in the steering shaft housing 12 in a conventional manner. The prior art electrical contacting device 10 in this figure comprises an annular conductive plate 20 which is concentrically mounted on the back portion of the boss of the steering wheel 14 and is connected to some electrical device such as horn-button (not shown) on the steering wheel 14. Slidably contacting at the free end thereof on the outer surface of the annular conductive plate 20 is a spring arm 22 which is fixed at the other end thereof to a switch box 24 of a trafficator lever and a head light control lever (not shown), the switch box 24 being mounted on the steering shaft housing 12 just below the steering wheel 14. The spring arm 22 is connected to the other electrical device such as horn (not shown) mounted on a stationary position of the vehicle and is mechanically biased toward the annular conductive plate 20 so that the free end thereof constantly contacts the annular conductive plate 20.

In this prior art electrical contacting device, however, the biasing force of the spring arm 22 against the annular conductive plate 20 must be relatively small in order to render the wear between the two members 20 and 22 as small as possible. Accordingly, if the surface of the annular conductive plate 20 is not sufficiently smooth, or when the surface has been worn by the spring 22, and further when severe vibration of the steering wheel 14 relative to the vehicle body occurs during the vehicle operation, the free end of the spring arm 22 is subjected to disconnection from the outer surface of the annular conductive plate 20. Therefore, reliable and continuous electrical connection between the two electrical devices cannot be accomplished. Accordingly, if the above-mentioned prior art contacting device is employed in the air-bag system, the severe vibration of the vehicle may cause the disconnection of the spring arm 22 and subsequent failure of the air-bag.

Therefore, as stated hereinbefore, the present invention is presented for overcoming such drawbacks of the prior art electrical contacting device where an electrical connection between a stationary conductive member and a rotatable conductive member is required.

Figure 2:
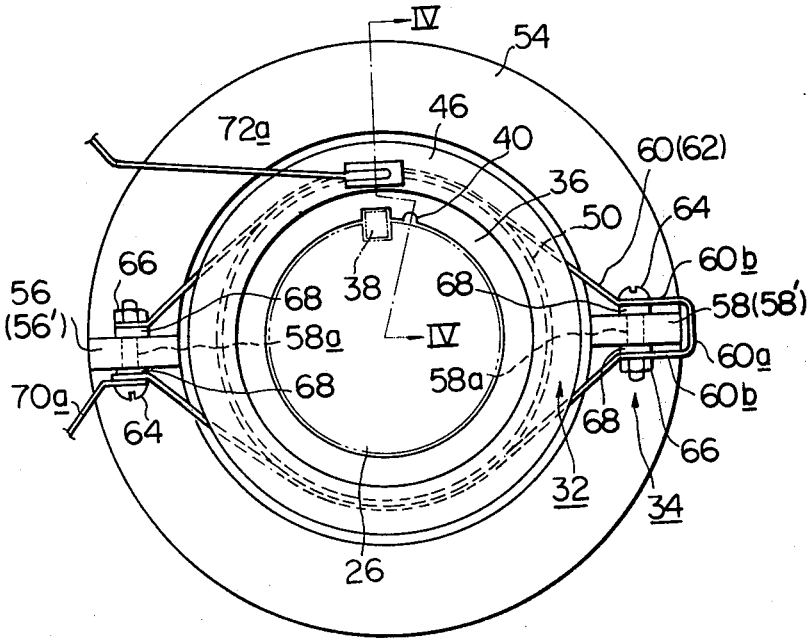
FIG. 2 is a front view of an electrical contacting device embodying the present invention, the device being positioned around a steering shaft.
Figure 3:
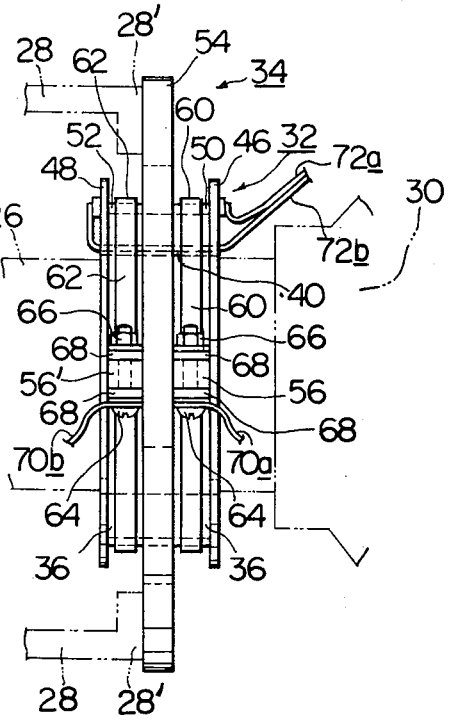
FIG. 3 is a side view of the device shown in FIG. 2.
Figure 4:
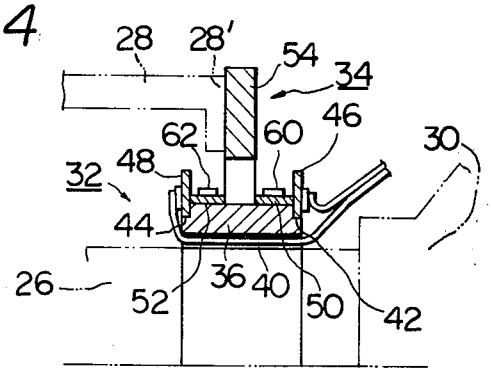
FIG. 4 is a view taken on line IV—IV of FIG. 2.

Referring to FIGS. 2 to 4, there is shown a first embodiment of the electrical contacting device according to the present invention in which the device is incorporated with a conventional steering system. The conventional steering system herein shown includes a steering shaft 26, a steering shaft housing 28 and a steering wheel 30 which are indicated in these figures by phantom lines.

The electrical contacting device in this embodiment generally comprises inner members 32 unitedly mounted on the steering shaft 26, and outer members 34 unitedly mounted on a relatively stationary member such as the steering shaft housing 28. Further, the outer members 34 are located around and radially spaced apart from the inner members 32 for providing free rotation of the inner members 32 therewithin.

The inner members 32 include a cylindrical base member 36 which is fixedly and coaxially coupled onto the steering shaft 26 by means of a key 38. The cylindrical base member 36 is constructed of an insulating material and is provided with a groove 40 extending longitudinally along the inner wall thereof for reasons which will be described hereinafter. As well shown in FIG. 4, a pair of step portions 42 and 44 are formed around the longitudinal edge portions of the cylindrical base member 36. Firmly coupled into the step portions 42 and 44 are a pair of flange members 46 and 48, respectively, which radially outwardly extend from the corresponding edge portions of the cylindrical base member 36. Concentrically and steadily mounted around the cylindrical base member 36 between the pair of flange members 46 and 48 are a pair of spaced annular plate members 50 and 52 which contact the corresponding flange members 46 and 48 at the outward edges thereof. These flange members 46, 48 and the annular plate members 50, 52 are constructed of electrical conducting materials.

The outer members 34 comprise an annular outer holder 54 which is connected at the one side thereof to a top end portion 28' of the steering shaft housing 28 in such a manner that the annular outer holder 54 is concentrically located around substantially equidistant between the pair of flange members 46 and 48. On each side of the annular outer holder 54, there are formed a pair of bracket portions 56 and 58 (56' and 58') which are located in opposite positions with respect to the center of the annular outer holder 54. It should be noted that the annular outer holder 54 is formed with not only the pair of bracket portions 56 and 58 on the front side thereof, but also the other pair of bracket portions 56' and 58' on the back side thereof.

In order to make the above-mentioned constructions of the inner members 32 and the outer members 34 act as the electrical contacting device, the following parts are required. A pair of spring bands 60 and 62, spring band fastening members such as bolts 64 and nuts 66, insulators 68, and lead lines 70*a*, 70*b*, 72*a* and 72*b*. These parts are mounted on both sides of the annular outer holder 54 in a symmetrical relation as shown in FIG. 3. Therefore, to simplify the explanation, only the members located on the front side of the annular outer holder 54 will be explained as follows.

As better shown in FIG. 2, the spring band 60 is extended between the two bracket portions 56 and 58 so that the spring band 60 is urged into sliding contact with the annular plate member 50 which is coaxially disposed on the cylindrical base member 36 as previously described. In this instance, the spring band 60 is secured to the bracket portions 56 and 58 by means of the bolts 64 and nuts 66 and insulated from the same by means of the insulating member 68 such as rubber washers and rubber sleeves. It is not to be noted that the spring band 60 is so formed to have a non-flexed part 60*a* at the generally middle portion thereof, the non-flexed part 60*a* being embraceably arranged around the bracket portion 58. It is also to be noted that the both ends of the spring band 60 are respectively connected to both sides of the bracket portion 56 through the insulating member 68 by means of the bolt 64 passing through a hole 58*a* formed in the bracket portion 56. It is further to be noted that the non-flexed part 60*a* has parallel sections 60*b* thereof respectively connected to both sides of the bracket portion 58 in substantially same manner as the both ends of the spring band 60. These construction will be readily apparent from the FIG. 2. Accordingly, the urging force of the spring band 60 against the annular plate member 50 can be controlled by tightening or loosing the bolts 64.

The other spring band 62 positioned on the back side of the annular outer holder 54 is supported on the bracket portions 56' and 58' in substantially same manner as the spring band 60.

If desired, an electrical conducting lubricant or conductive grease is applied to suitable peripheral surfaces of the annular plate members 60 and 62 in order to reduce friction and wear while providing desired conductivity between the spring bands 60 and 62, and the annular plate members 50 and 52.

The pair of lead wires 70*a* and 70*b* communicated with an electrical device such as an impact detecting device (not shown) mounted on a relatively stationary position of the vehicle are respectively connected to the pair of spring bands 60 and 62 by means of the bolts 64 and nuts 66. Further, the other pair of lead wires 72*a* and 72*b* communicated with the other electrical device such as an electrical gas generator of an air-bag (not shown) mounted on the steering wheel 30 are respectively connected to the flange members 46 and 48 via suitable technique such as welding. In this instance, the lead wire 72*b* is passed through the previously mentioned groove 40 formed in the cylindrical base member 36.

With the above-mentioned construction of the electrical contacting device of the invention, an electrical connection between the two electrical devices such as the impact detecting device and the electrical gas generally device of the air-bag can be reliably and continuously maintained even though the angular positions of the inner and other members 32 and 34 are frequently changed with respect to each other due to the steering operations of the vehicle driver.

Figure 5:
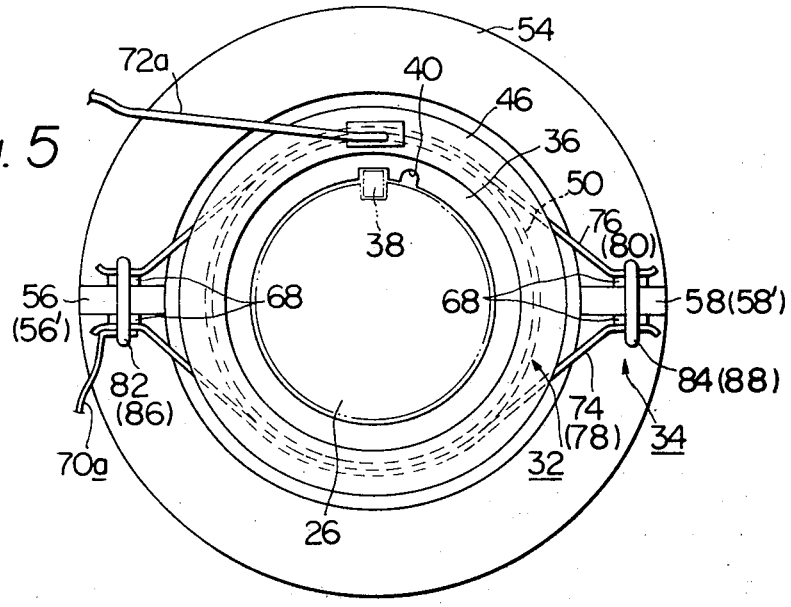
FIG. 5 is a front view of another embodiment of the invention.
Figure 6:
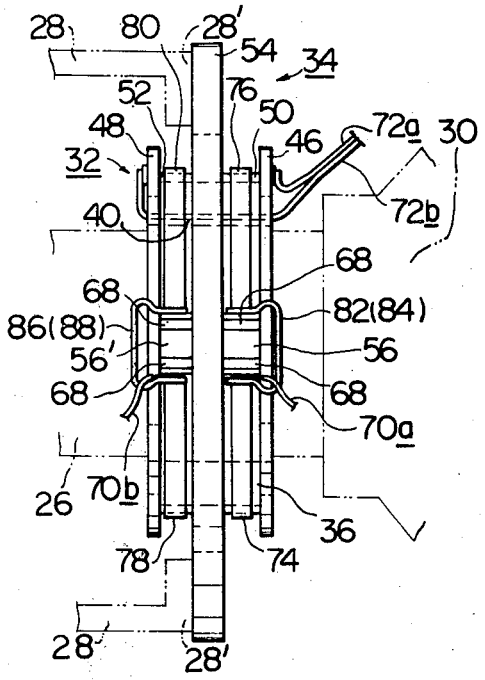
FIG. 6 is a side view of the device shown in FIG. 5.

Now, referring to FIGS. 5 and 6, there is shown a second embodiment of the electrical contacting device according to the present invention which device is generally same as the first embodiment with a few exceptions. To simplify the explanation of the second embodiment, explanation will not be made hereinbelow with respect the arrangements of the inner members 32 and the outer members 34 which are the same as those of first embodiment shown in FIGS. 2 to 4.

In this second embodiment, two spring bands are located on each side of the annular outer holder 54. The bands 74 and 76 are respectively extended between the two bracket portions 56 and 58 formed on the front side of the annular outer holder 54 so that each of the spring bands 74 and 76 is urged into sliding contact at the middle portion thereof with the annular plate member 50. The both ends of each spring band are respectively connected to the bracket portions 56 and 58 by means of generally U-shaped clip members 82 and 84 which are made of conductive resilient materials. The spring bands 74 and 76 are insulated from the bracket portions 56 and 58 by means of the insulating members 68 disposed between them. On the back side of the annular outer holder 54 are located the other two spring bands 78 and 80 which are clipped on the other bracket portions 56' and 58' in the same manner as the spring bands 74 and 76.

It is now to be noted that the clip members 82, 84 (86, 88) are caused to resiliently open and close in accordance with the force applied thereto from the annular plate member sliding middle portions of the spring bands. Accordingly, the biasing force of the spring bands 74 and 76 against the annular plate member can be controlled by the resiliently of the clip members.

Although in these first and second embodiments, the electrical contacting devices are illustrated to employ a pair of annular plate members 50 and 52, and two sets of spring bands 60, 62 and 74, 76, 78 and 80 for providing two way electrical connections between the two electrical devices such as the impact detecting device and the electrical gas generator of the air-bag, it is possible to employ only one annular plate member 50 and a set of spring band(s) 60, (74, 76) for providing one way electrical connection if the electrical transmittance between the two electrical devices is not critical, such as in a case of horn-system. In such case, the steering shaft 26 is used as the other electrical conductor.

With the above-described construction of the electrical contacting device according to the present invention, the following merits and advantages are possible.

1. Since the spring band is so constructed as to surround the annular plate member in contact, the contacting surfaces between them can be relatively larger thereby providing a relatively small electrical resistance therebetween, further the spring band can be made of a material having a relatively low spring constant. Accordingly, not only the rapid wearing of the contacting surfaces of the spring band and the annular plate member can be prevented, but also the deviation of the contact force of the spring band against the annular plate member can be reduced to a minimum.

2. Since the spring band is firmly supported by a pair of bracket portions formed on the outer annular holder, slipping of the spring band from the corresponding annular plate member will not take place. Accordingly the electrical resistance between the spring band and the annular plate member will be maintained in stable condition.

As described hereinbefore, the present invention is provided to propose an improved electrical contacting device which can reliably and continuously accomplish electrical connection between a stationary electrical conductor and a rotatable electrical conductor even under the most severe vibrations or shocks.

While the present invention has been shown in only two embodiments it will be obvious to those skilled in the art that is not so limited, but is susceptible to various other changes and modifications without departing from the spirit thereof.

What is claimed is:

1. An electrical contacting device for providing continuous electrical connection between first and second electrical devices mounted on a rotatable shaft and a relatively stationary member, respectively, comprising:

at least one annular conductive plate coaxially securely and insulatedly mounted on said rotatable shaft, said annular conductive plate being electrically connected with said first electrical device;

an outer annular holder concentrically positioned around and radially spaced apart from said annular conductive plate for forming a generally toroidal gap between said annular conductive plate and said outer annular holder, said outer annular holder being securely connected to said relatively stationary member; and at least one conductive spring band supported on said outer annular holder so as to be urged into sliding contact with the outer surface of said annular conductive plate, said conductive spring band being insulated from said outer annular holder and electrically connected to said second electrical device.

2. An electrical contacting device as claimed in claim 1, further comprising a cylindrical base member constructed of an insulating material, said cylindrical base member being firmly and coaxially disposed between said rotatable shaft and said annular conductive plate.

3. An electrical contacting device as claimed in claim 2, further comprising at least one flange member coaxially mounted on a longitudinal edge portion of said cylindrical base member, said flange member being electrically connected to said annular conductive plate.

4. An electrical contacting device as claimed in claim 3, in which said outer annular holder is formed at the one side thereof with a pair of bracket portions which are positioned oppositely with respect to the center of said outer annular holder, further in which said conductive spring band is extended between said pair of bracket portions.

5. An electrical contacting device as claimed in claim 4, in which said conductive spring band is so arranged to embrace said annular conductive plate in such a manner that one of said bracket portions retains both ends of said conductive spring band and the other bracket portion retains a generally middle portion of said conductive spring plate.

6. An electrical contacting device as claimed in claim 5, in which said both ends of said conductive spring band are respectively connected to both sides of said one of said bracket portions by means of a bolt and a nut through an insulator, further in which said generally middle portion of said conductive spring is formed with a non-flexed part embraceably arranged around and connected to said the other bracket portion by means of a bolt and a nut through an insulator.

7. An electrical contacting device as claimed in claim 6, in which said inflective part of said conductive spring band has parallel section thereof respectively connected to both sides of said the other bracket portion through said insulator by means of said bolt passing through a hole formed in said the other bracket portion, and said nut.

8. An electrical contacting device as claimed in claim 4, in which said conductive spring band comprises first and second members each of which has both ends respectively connected to said pair of bracket portions through insulators by means of a pair of generally U-shaped clip members.

* * * * *